United States Patent [19]

Shepherd

[11] 4,178,333

[45] Dec. 11, 1979

[54] HANGER ASSEMBLY FOR FILL STRIPS

[76] Inventor: Charles E. Shepherd, 4202 Markham, Houston, Tex. 77027

[21] Appl. No.: 915,651

[22] Filed: Jun. 15, 1978

[51] Int. Cl.[2] ..... B01F 3/04

[52] U.S. Cl. ..... 261/111; 248/74 A; 261/DIG. 11

[58] Field of Search ..... 261/111, DIG. 11, DIG. 41; 248/74 A

[56] References Cited

U.S. PATENT DOCUMENTS

| | | | |
|---|---|---|---|
| 2,108,347 | 2/1938 | Quarnstrom | 248/74 A |
| 3,643,931 | 2/1972 | Henning et al. | 261/111 |
| 3,749,381 | 7/1973 | Furlong et al. | 261/111 |
| 3,791,634 | 2/1974 | Phelps | 261/111 |
| 3,879,502 | 4/1975 | Furlong et al. | 261/111 |
| 3,894,127 | 7/1975 | Fordyce | 261/111 |
| 3,917,765 | 11/1975 | Furlong et al. | 261/111 |
| 4,115,484 | 9/1978 | Saxton | 261/111 |

*Primary Examiner*—Richard L. Chiesa
*Attorney, Agent, or Firm*—Donald D. Jeffery

[57] ABSTRACT

A hanger assembly to support fill strips in a cooling tower wherein the assembly includes headers and wire mesh hangers mounted on the headers. Each wire mesh hanger assembly includes vertical wires which have clamp portions formed at each end which extend through openings formed in the headers to suspend the wire mesh hanger from the header. The clamp portions include a cam surface which is compressed in the header opening when the clamp is moved to its operative position.

5 Claims, 3 Drawing Figures

HANGER ASSEMBLY FOR FILL STRIPS

BACKGROUND OF THE INVENTION

The present invention relates to an improved hanger assembly for fill strips of the type used in cooling towers to facilitate heat transfer and consequent cooling of the liquid passing downwardly through the tower.

In typical cooling tower constructions, the hot liquid to be cooled gravitates downwardly through the cooling tower and is removed as cooled liquid from the bottom thereof. Air is circulated in the tower and the cooling is accomplished by heat transfer from the surface of the liquid to the circulating air. The cooling is basically accomplished by evaporation from the surface of the liquid droplets, and the rate of cooling is determined by the rate or velocity of air flow through the tower and by the time required for the free or gravity fall of the liquid through the tower, with a longer retention time of the liquid during such fall obviously increasing the total heat transfer to the circulated air.

In order to increase the exposure time of the liquid to the air, it is well known in the art to provide means extending generally transversely in the tower which form surface areas onto which the liquid falls resulting in liquid splash and the consequent breakup into liquid particles. The greater the breakup due to such splashing, the greater the exposure time of the liquid particles to the air being circulated, and consequently the greater is the heat transfer and cooling. The transversely extending members are normally referred to as fill strips, and various types of fill strips and supporting hangers for the same are disclosed in U.S. Pat. Nos. 3,749,381 to Donn B. Furlong, et al; 3,791,634 to Peter M. Phelps and 3,894,127 to Homer E. Fordyce. The disclosure of each of these patents is characterized by a particular form of fill and means for supporting or suspending the fill in the tower, or both. U.S. Pat. No. 3,791,634 makes reference to a conventional cooling tower in which a number of horizontally disposed slats, which are normally of wood construction, are secured in staggered rows one above the other by means of wires. The staggering results in the liquid necessarily gravitating from one slat to a laterally positioned slat therebelow so that the liquid drops through a discontinuous path, with the exposure time of the liquid in the tower being determined by the vertical spacing of the adjacently disposed and staggered slats.

Although U.S. Pat. No. 3,791,634 refers to the supporting of the slats by wires, there are various methods known in the art for supporting the fill strips, and all supporting methods presently known to applicant are characterized by being relatively expensive, with respect to either material costs or time consuming installation requirements. Although wire mesh has been used for supporting the fill slats, present techniques for mounting the wire mesh are undesirable and very labor intensive. It will be understood that at least two supports or hangers are required for each slat in order to support the slats in at least two locations, and the fill hangers or supports are frequently spaced approximately two feet apart thereby necessitating even greater installation time, depending of course on the diameter or transverse dimension of the cooling tower.

SUMMARY OF THE INVENTION

With the above in mind, a principal object of the present invention is to provide a fill hanger assembly which is very simple in construction and which can be installed in the cooling tower with a minimum expenditure of time. In accordance with the invention, the hangers comprise headers, which can conveniently and inexpensively be constructed of wood, and positioned between the headers are vertically and horizontally spaced and interconnected wire members which form a wire mesh. The dimensions of the mesh opening, that is, the distance between vertically spaced wires and horizontally spaced wires can be varied as desired to provide the necessary width to receive the fill slats and to control the vertical drop between adjacent slats as above described. The top header can conveniently be secured to the top of the tower or to the side wall of the tower adjacent the top, and the construction of the header and wire mesh mounted between headers is such that the header and associated mesh can be hung quickly and yet very securely vertically downwardly from the top header to the desired elevation in the cooling tower. Once the headers and associated hangers have been suspended as described, the slats can be positioned laterally in the tower for support by the horizontally extending wires forming the mesh.

A further, more specific object of the invention, is to provide a simple and easily assembled connection between the wire mesh and the support header. In accordance with the invention, the vertical wires of the wire mesh are bent at right angles to the vertical at both the upper and lower ends thereof. The bent end portions are then further bent to form a clamp which can be pushed through an opening therefor provided in the header. The clamp is formed with a leading, inclined cam surface, the trailing end of which forms a shoulder adapted to contact the adjacent surface of the header to prevent withdrawal of the clamp, and thus the wire hanger, once the hanger has been installed in place. The opposed legs of the clamp end of each hanger wire are spaced so as to permit relative movement thereof a sufficient distance to accommodate movement of the cam surface of the clamp end when the same is pushed through the opening in the header. Each hanger assembly can therefore be quickly and easily snapped into place, and the opening in the header is sufficiently wide to accommodate the clamp ends of the hanger wires of the hanger assemblies positioned both above and below the header. In this manner, a series of headers and hanger assemblies can be hung vertically in the cooling tower in a very expedient manner which requires a minimum of installation time.

These and other objects of the invention will become apparent as the following description proceeds in particular reference to the application drawings.

BRIEF DESCRIPTION OF THE APPLICATION DRAWINGS

DETAILED DESCRIPTION OF THE PREFERRED EMBODIMENT

Figure 1:
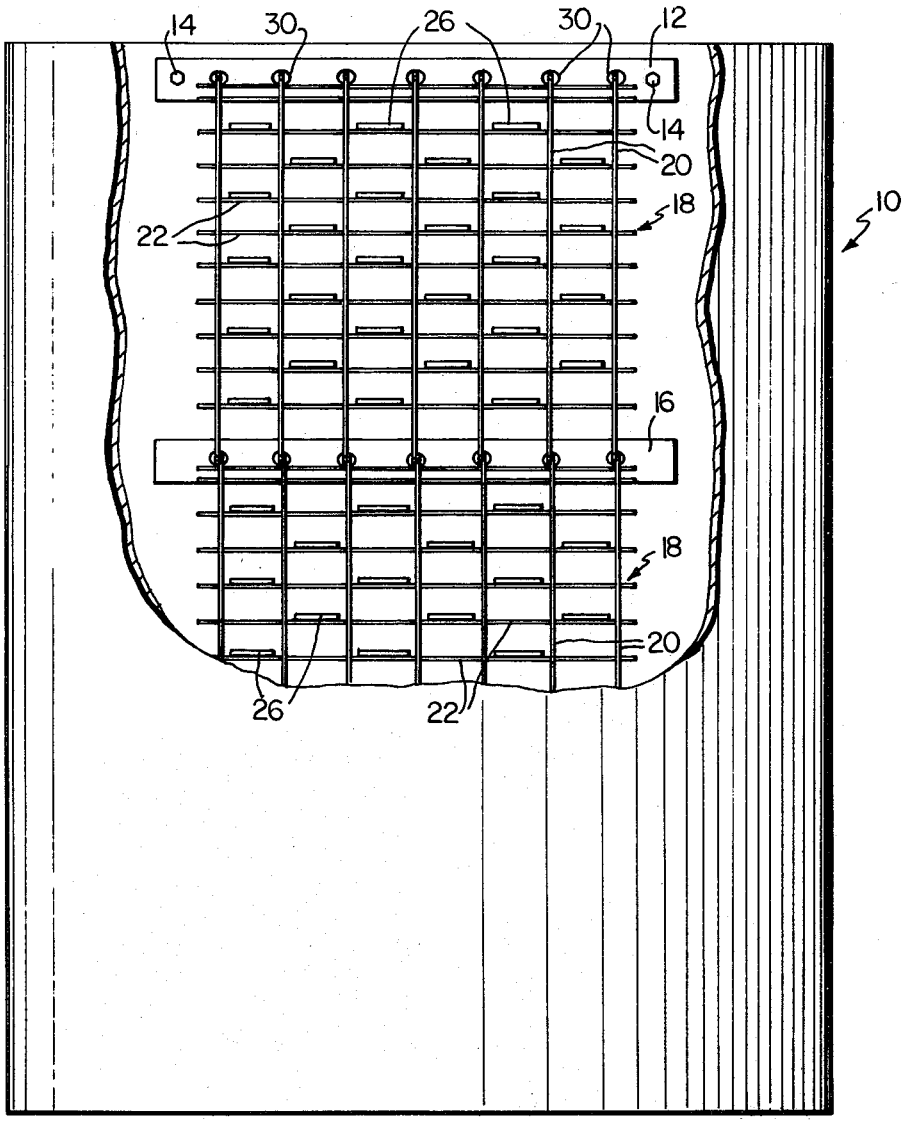
FIG. 1 illustrates diagrammatically a cooling tower, partially broken away to show the hanger assemblies, supporting headers, and slats supported by the wire assemblies.

Referring to the application drawings, wherein like parts are indicated by like reference numerals, a cooling tower is diagrammatically shown at 10, and has been illustrated only to provide a clear understanding of the present improvements. The invention does not reside in the construction of the cooling tower but only in the hanger assembly for the fill strips positioned in the tower.

A top header 12 can be mounted in the tower either on the top thereof or on the side wall of the tower relatively adjacent the top. In the form shown, the header 12 is mounted on the side walls by mounting bolts commonly designated at 14, although it will be understood that other methods of mounting the header to the wall of the tower could also be employed. A second header 16 is positioned below the first header and spaced therefrom by the hanger assembly generally indicated at 18. Although only headers 12 and 16 have been shown in FIG. 1, it will be understood and apparent as the following description proceeds that additional headers may be provided as necessary to accomplish the desired cooling effect of the liquid gravitating through the cooler.

Each hanger assembly 18 is operatively connected at the vertical opposite ends thereof to the headers, with the hanger assembly 18 comprising a wire mesh formed of vertically extending wire members 20 and horizontally extending wire members 22. The wires 20 and 22 are rigidly secured to each other at each point of intersection by means of welding or the like, in known manner, to provide a hanger assembly having the desired vertical and horizontal dimensions. In the form shown, the spacing between the vertical wires 20 is greater than the space between the horizontal wires 22, although it will be understood that any desired vertical or horizontal spacing can be provided to form the desired mesh opening formed by adjacent wires. In accordance with the present invention, it has been found convenient to space the vertical wires approximately 8" apart and the horizontal wires approximately 4" apart thereby to define a mesh opening 8"×4". The spacing of the vertical wires must be such as to accommodate the slat fill members which are commonly designated at 26. In each section of the hanger assembly between vertical wires, the slats are positioned on every other wire so that the liquid gravitating through the tower is forced along a discontinuous path, with the vertical distance between adjacent slats controlling the distance of the drop of the liquid. As above described, the dropping produces splashing thereby breaking up the liquid into particles more susceptible to the air circulated for cooling purposes through the tower. Although air circulation means have not been diagrammatically shown in FIG. 1, it will be understood that air is supplied in the necessary amounts and velocity to the cooling tower to effect the desired cooling. It will also be understood that the width of the slats corresponds to the spacing between the vertical wires so as to prevent dropping of the liquid entirely through the tower without contacting each fill slat in the path of the liquid.

Figure 2:
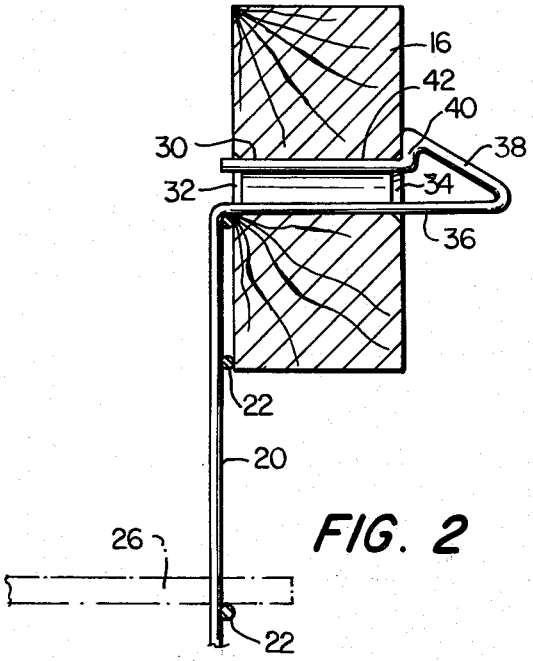
FIG. 2 is a sectional view taken through a header, showing more clearly the manner in which the clamp end of a wire hanger extends through the opening therefor in the header.
Figure 3:
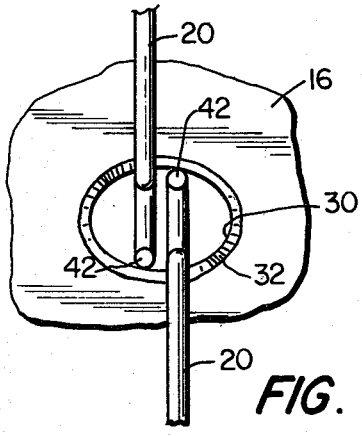
FIG. 3 is a fragmentary, front elevational view showing the manner in which the clamp ends from vertically adjacent hanger assemblies are mounted through the opening in the header.

Referring to FIGS. 2 and 3, each header 12 and 16 is formed with a series of aligned openings commonly designated at 30 which extend entirely through the header. Each opening can be beveled at the front and rear faces of the header as shown at 32 and 34 in FIG. 2 of facilitate the clamping arrangement to be presently described. As shown in FIG. 1, the number of openings 30 corresponds to the number of vertical wires in the hanger assembly, with the spacing of the openings corresponding to the spacing of the vertical wires.

Each vertical wire 20 is laterally bent at both the top and bottom thereof to form a first leg portion 36 of the clamp end. The leg portion 36 is then reversely bent to form an inclined or beveled cam portion 38, a shoulder portion 40 and a second leg portion 42 which is aligned with but spaced above the first leg portion 36. The bending of the wire provides an inherent resiliency in the cam portion 38 and leg 42 which tends to spread the leg portion 42 from the first leg portion 36. In the assembled position of the clamp end of the wire as shown in FIG. 2, the leg portion 42 therefor is resiliently biased against the adjacent surface of the opening 30 whereby the clamp end is tightly received in the opening 30 formed in the header. Also as shown in FIG. 2, the shoulder 40 is positioned behind and tightly engages the adjacent surface of the header thereby preventing withdrawal of the clamp end once the same has been installed as shown in FIG. 2. It will be understood that the length of the lateral bent end of each vertical wire 20 is such as to provide the dimensional relationship shown in FIG. 2 of the cam portion 38, the shoulder 40 and the leg portion 42, with the end of the latter extending slightly in front of the front surface of the header.

To install the assembly 18 on a header, the assembly is positioned so that the clamp end of each vertical wire 20 is generally aligned with an associated opening 30 in the header. The leading ends of the clamp ends are then pushed into the opening 30, with such movement being facilitated by the beveled surface 32, whereby both the cam portion 38, the shoulder 40 and the leg 42 are compressed toward the first leg portion 36 of the clamp end. The vertical dimension of the opening 30 and the spacing between the leg portion 36 and the top most surface of the cam portion 38, which forms the shoulder 40, is such that the clamp end can be pushed through the opening 30 without difficulty. Once the shoulder portion 40 has cleared the opening 30, the resiliency of the wire material will cause the shoulder 40 to snap up behind the adjacent surface of the header, and the leg portion 42 to tightly engage the opening. The positioning of the shoulder following such snapping action prevents the withdrawal of the clamp end unless and until the cam portion 38 is compressed to permit withdrawal of the clamp end from the opening. It will further be noted that the horizontal wires most adjacent the clamp end of the vertical wire 20 rest against the surface of the header, thereby providing stability for the entire assembly.

As shown in FIG. 1, the header 16 receives the clamp ends of the vertical wires for the uppermost hanger assembly 18, and also receives the clamp ends of the upper ends of the vertical wires 20 in the hanger assembly shown lowermost in FIG. 1. To receive both clamp ends, the opening 30 in the header is preferably generally oblong in shape, as shown in FIG. 3, with the horizontal dimension being extended to accommodate the double mounting, while the vertical dimension remains on a generally circular radius to provide the tight fitting of each clamp end as above described.

Although only two headers and two hanger assemblies 18 have been shown in FIG. 1, it will be apparent that similar assemblies will be provided at suitable, horizontally spaced distances across the cooling tower. The fill slats 26 must of course be supported at at least two locations, and a typical installation would comprise hanger assemblies spaced approximately 2 feet apart.

It will further be noted that by providing clamp ends at both the top and bottom of each hanger assembly, and forming the opening 30 in the header so as to receive a pair of clamp ends positioned in the header from either direction, both the headers and hanger assemblies are interchangeable relative to both direction and orientation. The system is thus highly flexible in use, in addition to permitting a series of hanger assemblies to be installed in a minimum amount of time and without the need for special tools or other accessories.

Although the wire mesh can be formed of any desirable material, satisfactory results have been obtained through the use of corrosive resistant steel mesh or metal mesh coated with a suitable plastic material, for example, polyvinylchloride. Such material is corrosion resistant over a wide range of temperature conditions. However other plastic materials known in the art may alternatively be used.

Based on the above description and application drawing, modifications may suggest themselves to those skilled in the art, without, however, departing from the scope of the invention as defined in the appended claims.

I claim:

1. A hanger assembly adapted for use in cooling towers comprising:

(a) at least one header formed with a plurality of openings extending through said header in aligned and spaced relation to each other, and (b) a mesh hanger assembly comprised of a first series of spaced members extending in one direction and a second series of spaced members extending in a direction generally perpendicular to said first series of members, said members thus forming a mesh having a plurality of openings adapted to receive fill slats, each of said members of said first series being formed with a clamp end at at least one end thereof, said clamp end comprising a first rigid load-supporting leg portion extending generally perpendicular to the axis of said member, a cam portion reversely bent relative to said first leg portion, a shoulder portion, and a second leg portion spaced from said first leg portion, the movement of said clamp end through an associated opening in said header serving to compress said cam portion and said second leg portion toward said first leg portion, after which the shoulder portion snaps into contact engagement with the adjacent surface of said header thereby to prevent withdrawal of said clamp end from said opening.

2. The hanger assembly of claim 1 wherein a plurality of headers and hanger assemblies are provided suspended vertically in the cooling tower, each of said members of said members of said first series being formed with a clamp end at both ends thereof, and said openings formed in said header are so dimensioned as to receive the clamp end of the bottom of one wire and the clamp end of the top of a second wire of the hanger assembly suspended below, whereby a series of headers and hanger assemblies can be provided covering the desired dimension in said cooling tower.

3. The hanger assembly of claim 1 wherein said members comprising said first and second series of members are formed of wire, with the members of said first series being connected to the members of said second series at their points of intersection.

4. The hanger assembly of claim 3 wherein said wire members are corrosive resistant steel or coated with plastic material.

5. The hanger assembly of claim 1 wherein the openings formed in said header are provided with a beveled entrance area to facilitate entry of said clamp end in and through said opening.

* * * * *